US010457898B2

(12) United States Patent
Pickering et al.

(10) Patent No.: US 10,457,898 B2
(45) Date of Patent: Oct. 29, 2019

(54) LIQUID DETERGENT COMPOSITION COMPRISING CELLULOSIC POLYMERS AND CELLULASE

(71) Applicant: The Procter & Gamble Company, Cincinnati, OH (US)

(72) Inventors: Carly Pickering, Tyne & Wear (GB); Alan Thomas Brooker, Newcastle upon Tyne (GB); Nigel Patrick Somerville Roberts, Newcastle upon Tyne (GB); Colin Ure, Tyne & Wear (GB)

(73) Assignee: The Procter & Gamble Company, Cincinnati, OH (US)

( * ) Notice: Subject to any disclaimer, the term of this patent is extended or adjusted under 35 U.S.C. 154(b) by 72 days.

(21) Appl. No.: 15/697,478

(22) Filed: Sep. 7, 2017

(65) Prior Publication Data

US 2018/0066212 A1 Mar. 8, 2018

(30) Foreign Application Priority Data

Sep. 7, 2016 (EP) ..... 16187537

(51) Int. Cl.

| | |
|---|---|
| ***C11D 1/22*** | (2006.01) |
| ***C11D 1/72*** | (2006.01) |
| ***C11D 1/83*** | (2006.01) |
| ***C11D 3/22*** | (2006.01) |
| ***C11D 1/12*** | (2006.01) |
| ***C11D 3/20*** | (2006.01) |
| ***C11D 3/30*** | (2006.01) |
| ***C11D 3/386*** | (2006.01) |
| ***C11D 17/00*** | (2006.01) |

(52) U.S. Cl.

CPC ..... *C11D 3/222* (2013.01); *C11D 1/12* (2013.01); *C11D 3/2003* (2013.01); *C11D 3/225* (2013.01); *C11D 3/227* (2013.01); *C11D 3/30* (2013.01); *C11D 3/38636* (2013.01); *C11D 3/38645* (2013.01); *C11D 17/0004* (2013.01)

(58) Field of Classification Search

CPC .... C11D 1/22; C11D 1/72; C11D 1/83; C11D 3/22; C11D 3/227; C11D 3/38645; C11D 17/045; B08B 3/04

See application file for complete search history.

(56) References Cited

U.S. PATENT DOCUMENTS

| | | | | |
|---|---|---|---|---|
| 5,443,750 | A | 8/1995 | Convents et al. | |
| 6,949,498 | B2 | 11/2005 | Murphy et al. | |
| 7,947,643 | B2 | 5/2011 | Lant | |
| 8,349,789 | B2 | 1/2013 | Lant | |
| 8,889,610 | B2 | 11/2014 | Labeque et al. | |
| 8,895,493 | B2 | 11/2014 | Labeque et al. | |
| 9,340,753 | B2 | 5/2016 | Tang et al. | |
| 9,714,403 | B2 | 7/2017 | Nagy et al. | |
| 2009/0318326 | A1* | 12/2009 | Lant ..... | C11D 3/222 510/320 |
| 2010/0075887 | A1 | 3/2010 | Wang et al. | |
| 2011/0319310 | A1* | 12/2011 | Labeque ..... | C11D 3/227 510/296 |
| 2015/0128223 | A1 | 5/2015 | Roberto et al. | |
| 2016/0040103 | A1 | 2/2016 | Depoot et al. | |
| 2017/0067004 | A1 | 3/2017 | Arora et al. | |
| 2018/0066211 | A1 | 3/2018 | Pickering et al. | |

FOREIGN PATENT DOCUMENTS

| | | | |
|---|---|---|---|
| WO | WO 91/08281 | A1 | 6/1991 |
| WO | WO 2010/072627 | A1 | 7/2010 |

OTHER PUBLICATIONS

U.S. Appl. No. 15/697,475, filed Sep. 7, 2017, Carly Pickering.
European Search Reports for application No. 16187534.9-1375, dated Feb. 24, 2017, 8 pages.
European Search Reports for application No. 16187537.2-1375, dated Feb. 24, 2017, 7 pages.
PCT Search Report for International App. No. PCT/US2017/049065, dated Nov. 22, 2017, 14 pages.

* cited by examiner

*Primary Examiner* — Brian P Mruk
(74) *Attorney, Agent, or Firm* — Gregory S. Darley-Emerson

(57) ABSTRACT

Liquid laundry detergent compositions comprising a first and a second cellulosic polymer and a cellulase. Related methods.

19 Claims, No Drawings

LIQUID DETERGENT COMPOSITION COMPRISING CELLULOSIC POLYMERS AND CELLULASE

FIELD OF THE INVENTION

The present disclosure relates to a liquid laundry detergent composition comprising a first and a second cellulosic polymer and a cellulase, water-soluble unit dose articles comprising said composition, methods of use of said composition and methods of making said composition.

BACKGROUND OF THE INVENTION

Cellulase has been formulated into liquid laundry detergent compositions. It provides 'depilling' benefits. This is where fibres from the fabrics become loose over time during wear etc and start to protrude from the surface of the fabrics. Over time these fibres form into small spherical bundles termed 'pills'. This is considered unsightly by consumers.

Cellulase removes these protruding fibres before they form into the pills so improving the overall appearance of the fabric.

However, there is a need for improved de-pilling benefit. Increasing cellulase levels is not preferred as this adds raw material cost and also cellulase could negatively interact with other laundry detergent ingredients. Furthermore, the level of cellulase cannot be too high as high levels have a negative effect on the fabrics per se.

It was surprisingly found that the combination of cellulase and a first cellulosic polymer as according to the present invention and a second cellulosic polymer as according to the present invention provided an improved depilling benefit.

SUMMARY OF THE INVENTION

The present disclosure relates to a liquid laundry detergent composition comprising;

a. between 0.0001% and 0.1% by weight of the liquid laundry detergent composition of a cellulase;
b. between 0.05% and 3% by weight of the liquid laundry detergent composition of a first cellulosic polymer, wherein the first cellulosic polymer is a cationically modified cellulosic polymer;
c. between 0.05% and 3% by weight of the liquid laundry detergent composition of a second cellulosic polymer, wherein the second cellulosic polymer is a carboxymethyl cellulose, a hydrophobically modified carboxymethyl cellulose or a mixture thereof.

The present disclosure also relates to a water-soluble unit dose article comprising a water-soluble film and a liquid detergent composition according to the present invention, preferably wherein the water-soluble unit dose article comprises at least two compartments.

The present disclosure also relates to a method of washing comprising the steps of adding the liquid laundry detergent composition or water-soluble unit dose article according to the present invention to sufficient water to dilute the liquid laundry detergent composition by a factor of at least 300 fold to create a wash liquor and contacting fabrics to be washed with said wash liquor.

DETAILED DESCRIPTION OF THE INVENTION

Liquid Laundry Detergent Composition

The present disclosure relates to a liquid laundry detergent composition.

The term 'liquid laundry detergent composition' refers to any laundry detergent composition comprising a liquid capable of wetting and treating a fabric, and includes, but is not limited to, liquids, gels, pastes, dispersions and the like. The liquid composition can include solids or gases in suitably subdivided form, but the liquid composition excludes forms which are non-fluid overall, such as tablets or granules.

The liquid laundry detergent composition can be used in a fabric hand wash operation or may be used in an automatic machine fabric wash operation.

The liquid laundry detergent composition comprises between 0.0001% and 0.1%, preferably between 0.0002% and 0.05%, more preferably between 0.0003% and 0.01%, even more preferably between 0.0005% and 0.001% by weight of the liquid laundry detergent composition of a cellulase. By weight percentage of cellulase we herein mean the weight percentage of the active enzyme protein. The cellulase is described in more detail below.

The liquid laundry detergent composition comprises between 0.05% and 3%, preferably between 0.1% and 2%, more preferably between 0.2% and 1%, most preferably between 0.25% and 0.75% by weight of the liquid laundry detergent composition of a first cellulosic polymer wherein the first cellulosic polymer is a cationically modified cellulose. The first cellulosic polymer is described in more detail below.

The liquid laundry detergent composition comprises between 0.05% and 3%, preferably between 0.1% and 2%, more preferably between 0.25% and 1.5%, most preferably between 0.5% and 1.25% by weight of the liquid laundry detergent composition of a second cellulosic polymer wherein the second cellulosic polymer is a carboxymethyl cellulose, a hydrophobically modified carboxymethyl cellulose or a mixture thereof. The second cellulosic polymer is described in more detail below.

The liquid laundry detergent composition may comprise a brightener or a hueing dye or a mixture thereof.

The brightener may be selected from stilbene brighteners, hydrophobic brighteners and mixtures thereof. The brightener may comprise brightener 36, brightener 49, brightener 15 or a mixture thereof, preferably brightener 49.

The brightener may comprise stilbenes, preferably selected from brightener 36, brightener 15 or a mixture thereof. Other suitable brighteners are hydrophobic brighteners, and brightener 49. The brightener may be in micronized particulate form, having a weight average particle size in the range of from 3 to 30 micrometers, or from 3 micrometers to 20 micrometers, or from 3 to 10 micrometers. The brightener can be alpha or beta crystalline form.

Suitable brighteners include: di-styryl biphenyl compounds, e.g. Tinopal® CBS-X, di-amino stilbene di-sulfonic acid compounds, e.g. Tinopal® DMS pure Xtra and Blankophor® HRH, and Pyrazoline compounds, e.g. Blankophor® SN, and coumarin compounds, e.g. Tinopal® SWN.

Preferred brighteners are: sodium 2 (4-styryl-3-sulfophenyl)-2H-napthol[1,2-d]triazole, disodium 4,4'-bis{[(4-anilino-6-(N methyl-N-2 hydroxyethyl)amino 1,3,5-triazin-2-yl)];amino}stilbene-2-2' disulfonate, disodium 4,4'-bis{[(4-anilino-6-morpholino-1,3,5-triazin-2-yl)]amino} stilbene-2-2' disulfonate, and disodium 4,4'-bis(2-sulfostyryl)biphenyl. A suitable fluorescent brightener is C.I. Fluorescent Brightener 260, which may be used in its beta or alpha crystalline forms, or a mixture of these forms.

The hueing dye may comprise polymeric or non-polymeric dyes, pigments, or mixtures thereof. Preferably the hueing dye comprises a polymeric dye, comprising a chromophore constituent and a polymeric constituent. The chromophore constituent is characterized in that it absorbs light in the wavelength range of blue, red, violet, purple, or combinations thereof upon exposure to light. In one aspect, the chromophore constituent exhibits an absorbance spectrum maximum from about 520 nanometers to about 640 nanometers in water and/or methanol, and in another aspect, from about 560 nanometers to about 610 nanometers in water and/or methanol.

Although any suitable chromophore may be used, the dye chromophore is preferably selected from benzodifuranes, methine, triphenylmethanes, napthalimides, pyrazole, napthoquinone, anthraquinone, azo, oxazine, azine, xanthene, triphenodioxazine and phthalocyanine dye chromophores. Mono and di-azo dye chromophores are preferred.

The hueing dye may comprise a dye polymer comprising a chromophore covalently bound to one or more of at least three consecutive repeat units. It should be understood that the repeat units themselves do not need to comprise a chromophore. The dye polymer may comprise at least 5, or at least 10, or even at least 20 consecutive repeat units.

The repeat unit can be derived from an organic ester such as phenyl dicarboxylate in combination with an oxyalkyleneoxy and a polyoxyalkyleneoxy. Repeat units can be derived from alkenes, epoxides, aziridine, carbohydrate including the units that comprise modified celluloses such as hydroxyalkylcellulose; hydroxypropyl cellulose; hydroxypropyl methylcellulose; hydroxybutyl cellulose; and, hydroxybutyl methylcellulose or mixtures thereof. The repeat units may be derived from alkenes, or epoxides or mixtures thereof. The repeat units may be C2-C4 alkyleneoxy groups, sometimes called alkoxy groups, preferably derived from C2-C4 alkylene oxide. The repeat units may be C2-C4 alkoxy groups, preferably ethoxy groups.

For the purposes of the present invention, the at least three consecutive repeat units form a polymeric constituent. The polymeric constituent may be covalently bound to the chromophore group, directly or indirectly via a linking group. Examples of suitable polymeric constituents include polyoxyalkylene chains having multiple repeating units. In one aspect, the polymeric constituents include polyoxyalkylene chains having from 2 to about 30 repeating units, from 2 to about 20 repeating units, from 2 to about 10 repeating units or even from about 3 or 4 to about 6 repeating units. Non-limiting examples of polyoxyalkylene chains include ethylene oxide, propylene oxide, glycidol oxide, butylene oxide and mixtures thereof.

The liquid laundry detergent composition may comprise one or more further enzymes. Those skilled in the art will be aware of suitable enzymes. The enzyme may be selected from peroxidases, proteases, xylanases, lipases, phospholipases, esterases, cutinases, pectinases, keratanases, reductases, oxidases, phenoloxidases, lipoxygenases, ligninases, pullulanases, tannases, pentosanases, malanases, β-glucanases, arabinosidases, hyaluronidase, chondroitinase, laccase, and amylases, or mixtures thereof.

The liquid laundry detergent composition may comprise a non-soap anionic surfactant, preferably selected from linear alkylbenzene sulphonate, alkyl sulphate, alkoxylated alkyl sulphate or a mixture thereof.

Preferably, the non-soap surfactant is neutralised with an amine, preferably selected from monoethanolamine, diethanolamine, triethanolamine or a mixture thereof, more preferably monoethanolamine.

The liquid laundry detergent composition may comprise between 5% and 35%, preferably between 5% and 30%, more preferably between 6% and 25%, even more preferably between 6.5% and 20%, most preferably between 6.5% and 15% by weight of the liquid laundry detergent composition of an amine neutralised $C_{12-14}$ linear allcylbenzene sulphonate.

The liquid laundry detergent composition comprises between 5% and 35%, preferably between 6% and 30%, more preferably between 8% and 25%, even more preferably between 10% and 25%, most preferably between 12% and 25% by weight of the liquid laundry detergent composition of an amine neutralised $C_{12-14}$ linear allcylbenzene sulphonate.

By 'amine neutralised' we herein mean that the acid form, linear alkylbenzene sulphonic acid is neutralized to the corresponding linear alkylbenzene sulphonate salt using an amine-based neutralizing agent. Preferred amines include alkanolamines, more preferably an alkanolamine selected from monoethanolamine, diethanolamine, triethanolamine, or a mixture thereof, most preferably monoethanolamine.

The liquid laundry detergent composition may comprise alkyl sulphate, alkoxylated alkyl sulphate or a mixture thereof. Preferably, the liquid laundry detergent composition comprises between 5% and 35%, preferably between 5% and 25%, more preferably between 5% and 20%, most preferably between 5% and 15% by weight of the liquid laundry detergent composition of the alkyl sulphate, alkoxylated alkyl sulphate or a mixture thereof.

Preferably, the alkyl sulphate, alkoxylated alkyl sulphate or a mixture thereof is neutralised with an amine. Preferably the amine is an alkonaolmine preferably selected from monoethanolamine, diethanolamine, triethanolamine or a mixture thereof, more preferably monoethanolamine.

The liquid laundry detergent composition may comprise a non-ionic surfactant. Preferably, the non-ionic surfactant is selected from a fatty alcohol alkoxylate, an oxo-synthesised fatty alcohol alkoxylate, Guerbet alcohol alkoxylates, alkyl phenol alcohol alkoxylates or a mixture thereof. Preferably, the liquid laundry detergent composition comprises between 1% and 25%, preferably between 1.5% and 20%, most preferably between 2% and 15% by weight of the liquid laundry detergent composition of the non-ionic surfactant.

The liquid laundry detergent composition may comprise between 1% and 25%, preferably between 1.5% and 20%, more preferably between 2% and 15%, even more preferably between 3% and 10%, most preferably between 4% and 8% by weight of the liquid detergent composition of soap, preferably a fatty acid salt, more preferably an amine neutralized fatty acid salt. Preferably the amine is an alkanolamine more preferably selected from monoethanolamine, diethanolamine, triethanolamine or a mixture thereof, most preferably monoethanolamine.

The liquid laundry detergent composition may comprise from 1% to 30%, preferably from 2% to 20%, more preferably from 3% to 15% by weight of the liquid laundry detergent composition of water.

The liquid laundry detergent composition may comprise an adjunct ingredient selected from polymers, builders, dye transfer inhibiting agents, dispersants, enzyme stabilizers, catalytic materials, bleach, bleach activators, polymeric dispersing agents, anti-redeposition agents, suds suppressors, aesthetic dyes, opacifiers, perfumes, perfume delivery systems, structurants, hydrotropes, processing aids, pigments and mixtures thereof.

Without wishing to be bound by theory it is believed that the cellulase, the first cellulosic polymer and the second cellulosic polymer work synergistically to provide improved anti-pilling benefit. This is more surprising considering that the first cellulosic polymer is cationically charged and the second cellulosic polymer is generally anionically charged. Thus, the skilled person would expect these two polymers to interact and simply flocculate out of solution without providing any benefit. Furthermore, the skilled person might expect the first and second cellulosic polymers to be substrates for the cellulase and hence not see any kind of synergistic benefit.

Cellulase

The liquid laundry detergent composition comprises between 0.0001% and 0.1%, preferably between 0.0002% and 0.05%, more preferably between 0.0003% and 0.01%, even more preferably between 0.0005% and 0.001% by weight of the liquid laundry detergent composition of a cellulase.

Preferably, the cellulase comprises a fungal or microbial-derived endoglucanases, or mixture thereof, exhibiting endo-beta-1,4-glucanase activity (E.C. 3.2.1.4). Preferred cellulases include a bacterial polypeptide endogenous to a member of the genus *Bacillus* which has a sequence of at least 90%, 94%, 97% and even 99% identity to the amino acid sequence SEQ ID NO:2 in U.S. Pat. No. 7,141,403B2). Suitable endoglucanases are sold under the tradenames Celluclean®, Carezyme®, Celluzyme®, Carezyme Premium® and Whitezyme® (Novozymes A/S, Bagsvaerd, Denmark).

Suitable cellulases include endo-beta-1,4-glucanases, cellobiohydrolases and beta-1,4-glucosidases, of bacterial or fungal origin, from any family of glycosyl hydrolase showing cellulase activity. Chemically modified or protein engineered mutants are included. Suitable cellulases include cellulases from the genera *Bacillus, Pseudomonas, Humicola, Fusarium, Thielavia, Acremonium*, e.g., the fungal cellulases produced from *Humicola insolens, Myceliophthora thermophila* and *Fusarium oxysporum.*

The cellulase may comprise a cleaning cellulase belonging to Glycosyl Hydrolase family 45 having a molecular weight of from 17 kDa to 30 kDa, for example the endoglucanases sold under the tradename Biotouch® NCD, DCC and DCL (AB Enzymes, Darmstadt, Germany).

First Cellulosic Polymer

The liquid laundry detergent composition comprises between 0.05% and 3%, preferably between 0.1% and 2%, more preferably between 0.2% and 1%, most preferably between 0.25% and 0.75% by weight of the liquid laundry detergent composition of a first cellulosic polymer wherein the first cellulosic polymer is a cationically modified cellulosic polymer.

The first cellulosic polymer may have a molecular weight of between 100,000 and 800,000 daltons.

Those skilled in the art will be aware of ways to make the first cellulosic polymer using conventional chemical techniques.

Preferably the first cellulose polymer is selected from cationically modified hydroxyethyl cellulose, cationically modified hydroxypropyl cellulose, cationically and hydrophobically modified hydroxyethyl cellulose, cationically and hydrophobically modified hydroxypropyl cellulose, or a mixture thereof, more preferably cationically modified hydroxyethyl cellulose, cationically and hydrophobically modified hydroxyethyl cellulose, or a mixture thereof.

By "hydrophobically modified" we herein mean that one or more hydrophobic groups are bound to the polymer. By "cationically modified" we herein mean that one or more cationically charged groups are bound to the polymer.

The cationically modified hydroxyethyl cellulose preferably is hydroxyethyl cellulose derivatised with trimethyl ammonium substituted epoxide.

The first polymer can be synthesized in, and are commercially available in, a number of different molecular weights. In order to achieve optimal softening performance from the product, it is desirable that the cationic polymer used in this invention be of an appropriate molecular weight. Without wishing to be bound by theory, it is believed that polymers that are too high in mass can entrap soils and prevent them from being removed. The use of cationic polymers with an average molecular weight of less than 1,250,000 daltons, or with an average molecular weight of less than 850,000 daltons, and especially those with an average molecular weight of less than 500,000 daltons can help to minimise this effect without significantly reducing the softening performance of properly formulated products. On the other hand, polymers with a molecular weight of about 10,000 daltons or less are believed to be too small to give an effective softening benefit. Therefore the cationic polymer according to the invention preferably has a molecular weight of from about 10,000 daltons to about 1,250,000 daltons, preferably from about 30,000 daltons to about 850,000 daltons, more preferably from about 50,000 daltons to about 750,000 daltons, even more preferably from about 100,000 daltons to about 600,000 daltons, most preferably from about 200,000 daltons to about 500,000 daltons.

The cationic polymers according to the invention may also have a cationic charge density ranging from about 0.1 meq/g to about 5 meq/g, preferably from about 0.12 meq/g to about 4 meq/g, more preferably from about 0.14 meq/g to about 2.5 meq/g, even more preferably from about 0.16 meq/g to about 1.5 meq/g, most preferably from about 0.18 meq/g to about 0.7 meq/g, at the pH of intended use of the laundry composition. As used herein the "charge density" of the cationic polymers is defined as the number of cationic sites per polymer gram atomic weight (molecular weight), and can be expressed in terms of meq/gram of cationic charge. In general, adjustments of the proportions of amine or quaternary ammonium moieties in the polymer in function of the pH of the liquid laundry formulation in the case of amines, will affect the charge density. Without intending to be bound by theory, cationic polymers with a too high charge density are thought to be too sensitive to precipitate out with anionic compounds in the formulation, while cationic polymers with a too low charge density are thought to have a too low affinity to fabrics, compromising softness accordingly. Any anionic counterions can be used in association with cationic polymers. Non-limiting examples of such counterions include halides (e.g. chlorine, fluorine, bromine, iodine), sulphate and methylsulfate, preferably halides, more preferably chlorine.

The cationic polymer according to the invention might be "hydrophobically modified". We herein mean that one or more hydrophobic groups are bound to the polymer. Without intending to be bound by theory we believe that hydrophobic modification can increase the affinity of the polymer towards the fabric. Without intending to be limiting, the one or more hydrophobic groups can be independently selected from $C_1$-$C_{32}$ preferably $C_5$-$C_{32}$ alkyl; $C_1$-$C_{32}$ preferably $C_5$-$C_{32}$ substituted alkyl, $C_5$-$C_{32}$ alkylaryl, or $C_5$-$C_{32}$ substituted alkylaryl, (poly)alkoxy $C_1$-$C_{32}$ preferably $C_5$-$C_{32}$ alkyl or (poly)alkoxy substituted $C_1$-$C_{32}$ preferably $C_5$-$C_{32}$ alkyl or mixtures thereof. Hydrophobic substitution on the polymer, preferably on the anhydroglucose rings or alternatively on the nitrogen of the cationic substitution of the cationic polymer may range from 0.01% to 5% per glucose unit, more preferably from 0.05% to 2% per glucose unit, of the polymeric material.

Those skilled in the art will be aware of ways to make the first polymer using conventional chemical techniques. The first cationic cellulosic polymer may be lightly cross-linked with a dialdehyde, such as glyoxal, to prevent forming lumps, nodules or other agglomerations when added to water at ambient temperatures.

The first polymers according to the invention include those which are commercially available and further include materials which can be prepared by conventional chemical modification of commercially available materials. Commercially available cationic cellulose polymers according to the invention include those with the INCI name Polyquaternium 10, such as those sold under the trade names: Ucare Polymer JR 30M, JR 400, JR 125, LR 400 and LK 400 polymers; Polyquaternium 67 such as those sold under the trade name Softcat SK™, all of which are marketed by Amerchol Corporation, Edgewater N.J.; and Polyquaternium 4 such as those sold under the trade name: Celquat H200 and Celquat L-200, available from National Starch and Chemical Company, Bridgewater, N.J. Other suitable polysaccharides include hydroxyethyl cellulose or hydoxypropylcellulose quaternized with glycidyl $C_{12}$-$C_{22}$ alkyl dimethyl ammonium chloride. Examples of such polysaccharides include the polymers with the INCI names Polyquaternium 24 such as those sold under the trade name Quaternium LM 200 by Amerchol Corporation, Edgewater N.J.

Second Cellulosic Polymer

The liquid laundry detergent composition comprises between 0.05% and 3%, preferably between 0.1% and 2%, more preferably between 0.25% and 1.5%, most preferably between 0.5% and 1.25% by weight of the liquid laundry detergent composition of a second cellulosic polymer, preferably wherein the second cellulosic polymer is selected from carboxymethyl cellulose, a hydrophobically modified carboxymethyl cellulose or a mixture thereof.

As used herein, the term "celluloses" includes natural celluloses and synthetic celluloses. Celluloses can be extracted from plants or produced by microorganisms.

Suitable carboxymethyl cellulose has a structure according to the formula:

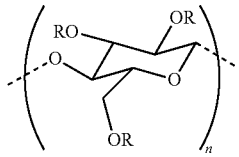

$R_a$ = —H
$R_b$ = —$CH_2CO_2Na$

Cellulose has three groups (R) available for substitution per repeating unit. For carboxymethyl cellulose, each R group will comprise either Ra or Rb with the 'degree of substitution' being defined as the average number of R groups per repeating cellulose unit that comprise Rb. Obviously in the case of carboxymethylcellulose, not all R groups will be Ra. The Rb moiety is the carboxymethyl substituent. The carboxymethyl cellulose has an average degree of carboxymethyl substitution of from 0.3 to 0.9, preferably from 0.4 and preferably to 0.8.

It may be preferred for the carboxymethyl cellulose to be further substituted with a hydrophobic moiety according to the following structure to give a hydrophobically modified carboxymethyl cellulose

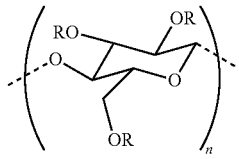

$R_a$ = —H
$R_b$ = —$CH_2CO_2Na$
$R_c$ = —C(=O)—CH($R^2$)—C(=O)—$CH_2$—$R^1$
$R_d$ = —C(=O)—$R^1$ wherein, each R group will comprise either Ra, Rb, Rc, or Rd in which R1 and R2 are independently selected from alkyl or alkenyl chains having from 5 to 22 carbon atoms. The Rb moiety is the carboxymethyl substituent. Obviously for hydrophobically modified carboxymethylcellulose, at least one Rb group will be present. The Rc and Rd moieties are examples of possible hydrophobic substituents. Alternative hydrophobic substituents will be recognized by persons skilled in the art. The 'degree of carboxymethyl substitution' is defined as the average number of R groups per repeating cellulose unit that comprise Rb. The carboxymethyl cellulose has an average degree of carboxymethyl substitution of from 0.3 to 0.9, preferably from 0.4 and preferably to 0.8. The 'degree of hydrophobic moiety substitution' is defined as the average total number of R groups per repeating cellulose unit that comprise Rc, and/or Rd. Preferably, the average degree of hydrophobic moiety substitution is in the range of from 0.001 to 0.2.

The carboxymethylcellulose preferably has a molecular weight of from 10,000 Da to 300,000 Da, preferably from 50,000 Da to 250,000 Da, most preferably from 100,000 Da to 200,000 Da.

In order to further improve the dissolution performance of the carboxymethyl cellulose, it may be preferred for a combination of smaller molecular weight and larger molecular weight carboxymethyl celluloses to be used, typically in such a manner so that a bimodal molecular weight distribution is achieved. Preferably, the carboxymethyl cellulose has a bimodal molecular weight distribution, wherein the first molecular weight modal has a peak in the range of from 10,000 Da to below 100,000 Da, and wherein the second molecular weight modal has a peak in the range of from 100,000 Da to 300,000 Da. Preferably, the first molecular weight modal has a peak in the range of from 20,000 Da or from 30,000 Da, and preferably to 90,000 Da, or to 80,000 Da, or to 70,000 Da. Preferably, the second second molecular weight modal has a peak in the range of from 120,000 Da, or from 150,000 Da, and preferably to 250,000 Da, or to 200,000 Da.

It may also be preferred for the carboxymethyl cellulose to have a degree of substitution (DS) in the range of from 0.01 to 0.99 and a degree of blockiness (DB) such that the sum of DS+DB is at least 1.00, preferably at least 1.05, or at least 1.10, or at least 1.15, or at least 1.20, or at least 1.25, or at least 1.30, or at least 1.35, or at least 1.40, or at least 1.45, or at least 1.50.

Preferably, the carboxymethyl cellulose has a degree of substitution (DS) in the range of from 0.01 to 0.99 and a degree of blockiness (DB) such that the sum of $DB+2DS-DS^2$ is at least 1.20, or at least 1.25, or at least 1.30, or at least 1.35, or at least 1.40, or at least 1.45, or at least 1.50.

Preferably, the carboxymethyl cellulose is a hydrophobically modified carboxymethylcellulose having a degree of substitution (DS) of from 0.01 to 0.99 and a degree of blockiness (DB) such that either DS+DB is of at least 1.00 and/or $DB+2DS-DS^2$ is at least 1.20.

A typical method to determine the degree of substitution (DS) of carboxymethyl cellulose (CMC) is described in more detail below. A typical method to determine the degree of blockiness (DB) of carboxymethyl cellulose (CMC) is described in more detail below.

Methods of producing carboxymethyl cellulose are well described in the art.

Various methods of producing hydrophobically modified carboxymethyl cellulose are disclosed in the art.

Carboxymethylcellulose polymers include Finnfix GDA (sold by CP Kelco), a hydrophobically modified carboxymethylcellulose, e.g. the alkyl ketene dimer derivative of carboxymethylcellulose sold under the tradename Finnfix SH1 (CP Kelco), or the blocky carboxymethylcellulose sold under the tradename Finnfix V (sold by CP Kelco).

Method to determine degree of carboxymethyl substitution (DS) of a carboxymethyl cellulose (CMC):The DS was determined by igniting CMC to ash at high temperature (650° C.) for 45 minutes in order to remove all the organic material. The remaining inorganic ashes were dissolved in distilled water and methyl red added. The sample was titrated with 0.1M hydrochloric acid until the solution turned pink. The DS was calculated from the amount of titrated acid (b ml) and the amount of CMC (G g) using the formula below.

$$DS=0.162*\{(0.1*b/G)/[1-(0.08*0.1*(b/G)]\}$$

Alternatively, the DS of a substituted cellulose may be measured by conductimetry or 13C NMR.

Method to determine degree of blockiness (DB) of a carboxymethyl cellulose (CMC): In the case of a substituted cellulose, the DB may correspond to the amount (A) of non-substituted glucose units released after a specific enzymatic hydrolysis with the commercial endoglucanase enzyme (Econase CE, AB Enzymes, Darmstadt, Germany) divided by the total amount of non-substituted glucose units released after acid hydrolysis (A+B). The enzymatic activity is specific to non-substituted glucose units in the polymer chain that are directly bounded to another non-substituted glucose unit.

The enzymatic degradation is performed using the enzyme (Econase CE) in a buffer at pH 4.8 at 50° C. for 3 days. To 25 ml of substituted cellulose sample, 250 mL of enzyme is used. The degradation is stopped by heating the samples to 90° C. and keeping them hot for 15 minutes. The acid hydrolysis for both substitution pattern and blockiness is carried out in perchloric acid (15 min in 70% HClO4 at room temperature and 3 hours in 6.4% HClO4 at 120° C.). The samples are analysed using Anion Exchange Chromatography with Pulsed Amperiometric Detection (PAD detector: BioLC50 (Dionex, Sunnyvale, Calif., USA)). The HPAEC/PAD system is calibrated with 13C NMR. The monosaccharides are separated at 35° C. using a flow rate of 0.2 ml/min on a PA-1 analytical column using 100 mM NaOH as eluent with increasing sodium acetate (from 0 to 1M sodium acetate in 30 mins). Each sample is analysed three to five times and an average is calculated. The number of unsubstituted glucose that were directly linked to at least one substituted glucose (A), and the number of unsubstituted glucose that were not directly linked to a substituted glucose (B) are deduced and the DB of the substituted cellulose sample is calculated: DB=B/(A+B).

Method to determine degree of hydrophobic moiety substitution of a hydrophobically modified carboxymethyl cellulose (CMC): The degree of hydrophobically moiety substitution is determined using FT-IR spectroscopy.

Use

The present disclosure also relates to the use of the liquid laundry detergent composition according to the present invention to provide fabric softness and improved fabric whiteness benefits.

Water-Soluble Unit Dose Article

The present disclosure also relates to a water-soluble unit dose article comprising a water-soluble film and a liquid detergent composition according to the present invention. Preferably, the water-soluble unit dose article comprises at least two compartments.

The water-soluble unit dose article comprises at least one water-soluble film shaped such that the unit-dose article comprises at least one internal compartment surrounded by the water-soluble film. The at least one compartment comprises the liquid laundry detergent composition. The water-soluble film is sealed such that the liquid laundry detergent composition does not leak out of the compartment during storage. However, upon addition of the water-soluble unit dose article to water, the water-soluble film dissolves and releases the contents of the internal compartment into the wash liquor.

The compartment should be understood as meaning a closed internal space within the unit dose article, which holds the composition. Preferably, the unit dose article comprises a water-soluble film. The unit dose article is manufactured such that the water-soluble film completely surrounds the composition and in doing so defines the compartment in which the composition resides. The unit dose article may comprise two films. A first film may be shaped to comprise an open compartment into which the composition is added. A second film is then laid over the first film in such an orientation as to close the opening of the compartment. The first and second films are then sealed together along a seal region. The film is described in more detail below.

The unit dose article may comprise more than one compartment, even at least two compartments, or even at least three compartments. The compartments may be arranged in superposed orientation, i.e. one positioned on top of the other. Alternatively, the compartments may be positioned in a side-by-side orientation, i.e. one orientated next to the other. The compartments may even be orientated in a 'tyre and rim' arrangement, i.e. a first compartment is positioned next to a second compartment, but the first compartment at least partially surrounds the second compartment, but does not completely enclose the second compartment. Alternatively one compartment may be completely enclosed within another compartment.

The film of the present invention is soluble or dispersible in water. The water-soluble film preferably has a thickness of from 20 to 150 micron, preferably 35 to 125 micron, even more preferably 50 to 110 micron, most preferably about 76 micron.

Preferably, the film has a water-solubility of at least 50%, preferably at least 75% or even at least 95%, as measured by the method set out here after using a glass-filter with a maximum pore size of 20 microns:

5 grams±0.1 gram of film material is added in a pre-weighed 3 L beaker and 2 L±5 ml of distilled water is added. This is stirred vigorously on a magnetic stirrer, Labline model No. 1250 or equivalent and 5 cm magnetic stirrer, set at 600 rpm, for 30 minutes at 30° C. Then, the mixture is filtered through a folded qualitative sintered-glass filter with a pore size as defined above (max. 20 micron). The water is dried off from the collected filtrate by any conventional method, and the weight of the remaining material is determined (which is the dissolved or dispersed fraction). Then, the percentage solubility or dispersability can be calculated.

Preferred film materials are preferably polymeric materials. The film material can, for example, be obtained by casting, blow-moulding, extrusion or blown extrusion of the polymeric material, as known in the art.

Preferred polymers, copolymers or derivatives thereof suitable for use as pouch material are selected from polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum. More preferred polymers are selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, and most preferably selected from polyvinyl alcohols, polyvinyl alcohol copolymers and hydroxypropyl methyl cellulose (HPMC), and combinations thereof. Preferably, the level of polymer in the pouch material, for example a PVA polymer, is at least 60%. The polymer can have any weight average molecular weight, preferably from about 1000 to 1,000,000, more preferably from about 10,000 to 300,000 yet more preferably from about 20,000 to 150,000.

Mixtures of polymers can also be used as the pouch material.

Preferred films exhibit good dissolution in cold water, meaning unheated distilled water. Preferably such films exhibit good dissolution at temperatures of 24° C., even more preferably at 10° C. By good dissolution it is meant that the film exhibits water-solubility of at least 50%, preferably at least 75% or even at least 95%, as measured by the method set out here after using a glass-filter with a maximum pore size of 20 microns, described above.

Preferred films are those supplied by Monosol under the trade references M8630, M8900, M8779, M8310.

The film may be opaque, transparent or translucent. The film may comprise a printed area.

The area of print may be achieved using standard techniques, such as flexographic printing or inkjet printing.

The film may comprise an aversive agent, for example a bittering agent. Suitable bittering agents include, but are not limited to, naringin, sucrose octaacetate, quinine hydrochloride, denatonium benzoate, or mixtures thereof. Any suitable level of aversive agent may be used in the film. Suitable levels include, but are not limited to, 1 to 5000 ppm, or even 100 to 2500 ppm, or even 250 to 2000 rpm.

The water-soluble unit dose article may comprise a first compartment wherein the first compartment comprises the first cellulosic polymer and the second cellulosic polymer, and a second compartment wherein the second compartment comprises the cellulase.

Method of Washing

The present disclosure also relates to a method of washing comprising the steps of adding the liquid laundry detergent composition or water-soluble unit dose article according to the present invention to sufficient water to dilute the liquid laundry detergent composition by a factor of at least 300 fold to create a wash liquor and contacting fabrics to be washed with said wash liquor.

The wash liquor may be created in the drum of an automatic washing machine. Alternatively, the wash liquor may be created in a hand wash operation.

Method of Making

The liquid laundry detergent composition of the present disclosure may be made using any suitable manufacturing techniques known in the art. Those skilled in the art would know appropriate methods and equipment to make the composition according to the present disclosure.

EXAMPLES

In order to demonstrate the impact of the compositions according to the present disclosure in providing de-pilling/fabric rejuvenation properties a fabric rejuvenation test was conducted.

Test Products:

The following Reference composition was prepared:

| Reference base | Wt. % | | Wt. % |
|---|---|---|---|
| Monopropylene Glycol | 11.16 | Amphiphilic graft copolymer | 4.41 |
| Glycerol | 3.77 | K2So3 | 0.44 |
| Dipropylene Glycol | 3.68 | Perfume | 2.65 |
| C12-14 ALCOHOL ETHOXYLATE AE7 | 3.77 | Ethoxylated Polyethylenepolyamine | 1.57 |
| Monoethanolamine Laureth Sulfate | 14.42 | Magnesium Chloride | 0.33 |
| Editronic Acid, neutralised | 2.42 | Water/Minors | 21.73 |
| Monoethanolamine Linear Alkyl Benzene Sulfonate | 21.22 | | |
| Enzymes | 0.8 | | |
| FWA 49 Tinopal ® CBS-X | 0.38 | | |
| Cremer AC PK12-18 Fatty Acid | 5.87 | | |
| Citric Acid | 1.38 | | |

The following premix composition was prepared:

| | |
|---|---|
| Polypropylene glycol | 60% |
| Cationically Modified hydroxyethyl cellulose | 37% |
| Acusol 880 | 3% |

The following test products were prepared;

A: Reference composition: 25.1 g added to drum of washing machine.

B: Reference composition (25.1 g) & cationically modified hydroxyethyl cellulose delivered via a premix added at 0.34 g & Cellulase 15 microliters delivering 0.015 ppm active, each added directly to the drum of a washing machine.

C: Reference composition (25.1 g) & Cellulase 15 microliters delivering 0.015 ppm active & Carboxymethyl cellulose 0.25 g delivered via powder material, each added directly to the drum of a washing machine.

D: Reference composition 25.1 g & Cellulase 15 microliters delivering 0.015 ppm active & cationically modified hydroxyethyl cellulose delivered via a premix added at 0.34 g each added directly into the drum of a washing machine.

Test Method:

White Cotton fabric tracers×12 (sourced by ex wfk Testgewebe GmbH Christenfeld 10. D-41379 Brüggen-Bracht Germany) were pre pilled and exposed to dye transfer by washing with 2 kg of Black Terry Towel ballast (black 100% cotton terry towels batch towels). A cotton short cycle was selected on a Miele machine (model 1714), 40° C., city water (7.8 gpg) total wash time 1 hour 25 mins×5 wash cycles. Fabric was removed and left over night in drying room 20 c/55% RH then used for test the following day. For the depilling/colour rejuvenation test a quick wash cycle was selected on a WH565 Programmable washing machine (program details stated below), 40 c, city water (7.8 gpg) 2.8 kg of a ballast of 3.8 kg was used consisting of 17×white tread 100% cotton knit and 12×blue thread 50/50 cotton/polyester blend knit fabrics (sourced from Calderon Textiles) (sourced from Calderon Textiles, composition in table below)×5 wash cycles carried out in wash liquors comprising the relevant composition A-D. Without wishing to be bound by theory, the measured whiteness of a fabric can be used as a measure of depilling. The tangled fibres in pills scatter and diffuse incident/reflected light such that the pills appear dark and reduce the overall reflectance of light, thereby lowering the overall L*a*b* values.

Wash Program Machine Model WH565's;
16 L pre-wash. 2.5 Min. Heat to 30° C. 5 Min.
Main Wash. 20 Min. Drain. 1 Min.
1000 rpm spin. 2.5 Min. 16 L Rinse. 8 Min.
Drain. 1 Min. 1000 rpm. 1 Min.
16 L Rinse. 8 Min. Drain. 1 Min.
1200 rpm Spin. 2 Min. Total 52.5 Min

| Description of Ballast: | |
|---|---|
| 100% Combed Cotton<br>2-Ply - sewed with WHITE thread<br>Interlock Fabric Construction<br>56 cm × 50 cm (pre-desized dimensions)<br>Weight: 140 g | 50% Combed Cotton/50% Polyester<br>2-Ply - sewed with BLUE thread<br>Interlock Fabric Construction<br>54 cm × 50 cm (pre-desized dimensions)<br>Weight: 126 g |

Fabric tracers were left overnight to dry in drying room (20 c/55% RH) and analysed using a bench-top spectrophotometer Konica—Minolta model CM-3630 which when combined with Polaris White Star software (ex Axiphos GmbH Arend-Braye Str. 42, D-79540 Loerrach, Germany) allows the extraction of reflectance data in the range of 360-740 nm. In order to determine the impact of cationically modified hydroxyethyl cellulose and Cellulase on overall whiteness maintenance CIE L*a*b was used (The three coordinates of CIELAB represent the lightness of the colour (L*=0 yields black and L*=100 indicates diffuse white; specular white may be higher), its position between red/magenta and green (a*, negative values indicate green while positive values indicate magenta) and its position between yellow and blue (b*, negative values indicate blue and positive values indicate yellow) which was used to calculate the difference in colour vs fabrics pre-pilled/dyed prior to washing in relevant test products.

Results:

| | L* | a* | b* | C* | Delta E |
|---|---|---|---|---|---|
| Reference | 91.39 | −0.49 | 1.16 | 1.26 | |
| | 90.93 | −0.47 | 0.98 | 1.09 | |
| | 90.24 | −0.48 | 1.01 | 1.02 | |
| Average | 90.85 | −0.48 | 1.05 | 1.12 | 6.34 |
| Test Product B | 91.87 | −0.09 | 0.57 | 0.57 | |
| | 91.94 | −0.07 | 0.91 | 0.92 | |
| | 91.86 | −0.04 | 0.54 | 0.54 | |
| Average | 91.89 | −0.07 | 0.67 | 0.68 | 7.35 |
| Test Product C | 92.32 | −0.09 | 0.62 | 0.63 | |
| | 92.28 | −0.07 | 0.58 | 0.59 | |
| | 92.19 | −0.04 | 0.64 | 0.64 | |
| Average | 92.26 | −0.07 | 0.61 | 0.62 | 7.72 |
| Test Product D | 93.8 | −0.48 | 0.74 | 0.88 | |
| | 92.96 | −0.37 | 0.75 | 0.84 | |
| | 93.46 | −0.33 | 0.67 | 0.75 | |
| Average | 93.41 | −0.39 | 0.72 | 0.82 | 8.88 |

L a b* results shows the combination of a cationically modified hydroxyethyl cellulose and Carboxymethyl cellulose provides a boost in effectiveness for cellulase, as they provide a combined benefit bigger then the individual materials alone combined with cellulase. (Test Product B delta E + 1.01 vs A, +1.38 Test Product C vs A and +2.54 Test Product D vs A). Therefore, it is concluded that the combination of the first polymer, the second polymer and cellulase provides for improved depilling benefit The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A liquid laundry detergent composition comprising:

a. between about 0.0001% and about 0.1% by weight of the liquid laundry detergent composition of a cellulase;

b. between about 0.05% and about 3% by weight of the liquid laundry detergent composition of a first cellulosic polymer, wherein the first cellulosic polymer is a cationically modified cellulosic polymer;

c. between about 0.05% and about 3% by weight of the liquid laundry detergent composition of a second cellulosic polymer wherein the second cellulosic polymer is a hydrophobically modified carboxymethyl cellulose having a degree of substitution (DS) of from about 0.01 to about 0.99 and a degree of blockiness (DB) such that either DS+DB is of at least about 1.00 and/or DB+2DS-DS2 is at least about 1.20.

2. The liquid laundry detergent composition according to claim 1, wherein the first cellulosic polymer is selected from cationically modified hydroxyethyl cellulose, cationically modified hydroxypropyl cellulose, cationically and hydrophobically modified hydroxyethyl cellulose, cationically and hydrophobically modified hydroxypropyl cellulose, or a mixture thereof.

3. The liquid laundry detergent composition according to claim 2, wherein the first cellulosic polymer comprises one or more hydrophobic groups bound to the polymer and wherein the one or more hydrophobic groups can be independently selected from C1-C32 alkyl; C1-C32 substituted alkyl, C5-C32 alkylaryl, or C5-C32 substituted alkylaryl, (poly)alkoxy C1-C32 alkyl or (poly)alkoxy substituted C1-C32 alkyl or mixtures thereof.

4. The liquid laundry detergent composition according to claim 1 comprising between about 0.1% and about 2% by weight of the liquid laundry detergent composition of the first cellulosic polymer.

5. The liquid laundry detergent composition according to claim 1 comprising between about 0.1% and about 2% by weight of the liquid laundry detergent composition of the second cellulosic polymer.

6. The liquid laundry detergent composition according to claim 1 comprising between about 0.0002% and about 0.05% by weight of the liquid laundry detergent composition of the cellulase.

7. The liquid laundry detergent composition according to claim 1, wherein the cellulase comprises a fungal or microbial-derived endoglucanases, or mixture thereof, exhibiting endo-beta-1,4-glucanase activity.

8. The liquid laundry detergent composition according to claim 1 further comprising a non-soap anionic surfactant.

9. The liquid laundry detergent composition according to claim 8, wherein the non-soap surfactant is selected from linear alkylbenzene sulphonate, alkyl sulphate, alkoxylated alkyl sulphate or a mixture thereof.

10. The liquid laundry detergent composition according to claim 9 wherein the non-soap surfactant is neutralised with an amine, selected from monoethanolamine, diethanolamine, triethanolamine or a mixture thereof.

11. The liquid detergent composition according to claim 8 comprising a. between about 5% and about 30% by weight of the liquid laundry detergent composition of the amine neutralised C12-14 linear alkylbenzene sulphonate, wherein the amine is an alkanolamine, selected from monoethanolamine, diethanolamine, triethanolamine or a mixture thereof, or b. between about 5% and about 35% by weight of the liquid laundry detergent composition of an amine neutralised C12-14 linear alkylbenzene sulphonate, wherein the amine is an alkanolamine, selected from monoethanolamine, diethanolamine, triethanolamine or a mixture thereof.

12. The liquid laundry detergent composition according to claim 1 further comprising a non-ionic surfactant, wherein the liquid laundry detergent composition comprises between about 1% and about 25% by weight of the liquid laundry detergent composition of the non-ionic surfactant.

13. The liquid laundry detergent composition according to claim 12 wherein the non-ionic surfactant is selected from a fatty alcohol alkoxylate, an oxo-synthesised fatty alcohol alkoxylate, Guerbet alcohol alkoxylates, alkyl phenol alcohol alkoxylates or a mixture thereof.

14. The liquid laundry detergent composition according to claim 1 comprising between about 1.5% and about 20% by weight of the liquid detergent composition of soap.

15. The liquid detergent composition according to claim 14, wherein the soap is an amine neutralized fatty acid salt, wherein the amine is an alkanolamine selected from monoethanolamine, diethanolamine, triethanolamine or a mixture thereof.

16. A water-soluble unit dose article comprising a water-soluble film and a liquid detergent composition according to claim 1.

17. The water-soluble unit dose article according to claim 16 wherein the water-soluble unit dose article comprises at least two compartments.

18. The water-soluble unit dose article according to claim 17, wherein a first compartment comprises the first cellulosic polymer and the second cellulosic polymer, and a second compartment comprises the cellulase.

19. A method of washing comprising the steps of adding the liquid laundry detergent composition according to claim 1 to sufficient water to dilute the liquid laundry detergent composition by a factor of at least about 300-fold to create a wash liquor and contacting fabrics to be washed with said wash liquor.

* * * * *